US005988466A

United States Patent [19]

Brown

[11] Patent Number: 5,988,466

[45] Date of Patent: Nov. 23, 1999

[54] BODY MOUNTED FIREARM SUPPORT

[76] Inventor: Jerry L. Brown, 10929 Lookout Dr., Pinckney, Mich. 48169

[21] Appl. No.: 08/926,519

[22] Filed: Sep. 10, 1997

Related U.S. Application Data

[60] Provisional application No. 60/026,061, Sep. 13, 1996.

[51] Int. Cl.[6] ..... A45F 5/00

[52] U.S. Cl. ..... 224/185; 224/191; 224/197; 224/198; 224/660; 224/271; 224/913

[58] Field of Search ..... 224/185, 191, 224/197, 198, 200, 660, 271, 272, 913; 248/351, 354.1

[56] References Cited

U.S. PATENT DOCUMENTS

| | | | |
|---|---|---|---|
| D. 246,013 | 10/1977 | Morris et al. . | |
| 889,658 | 6/1908 | Burnaugh, Jr. . | |
| 1,406,827 | 2/1922 | Dumas . | |
| 2,692,069 | 10/1954 | Winters et al. | 224/913 |
| 3,191,826 | 6/1965 | Adams | 224/185 |
| 3,200,528 | 8/1965 | Christensen . | |
| 3,390,477 | 7/1968 | Galbraith . | |
| 4,081,115 | 3/1978 | White et al. . | |
| 4,327,986 | 5/1982 | Carter . | |
| 4,637,536 | 1/1987 | Wong . | |
| 4,844,390 | 7/1989 | Duke . | |
| 4,911,345 | 3/1990 | James et al. . | |
| 4,964,553 | 10/1990 | Glynn . | |
| 4,991,758 | 2/1991 | Eaneff . | |
| 5,029,741 | 7/1991 | Easter . | |
| 5,241,771 | 9/1993 | Caustic . | |
| 5,345,706 | 9/1994 | Brown . | |
| 5,351,867 | 10/1994 | Vest . | |
| 5,491,919 | 2/1996 | Rather et al. . | |
| 5,528,846 | 6/1996 | Baggett . | |
| 5,738,256 | 4/1998 | Goff et al. | 24/185 |

*Primary Examiner*—David J. Walczak
*Assistant Examiner*—Timothy L. Maust
*Attorney, Agent, or Firm*—Young & Basile, PC

[57] ABSTRACT

A firearm support includes an elongated tubular member. A receptacle attachable to a user worn belt supports a first end of the tubular member. An attachment member on a second end of the tubular member movably attaches the tubular member to a firearm. The attachment member allows pivotal movement of the firearm to form a first substantially vertical storage position in the receptacle to a substantially horizontal firing position. The receptacle enables universal movement of the tubular member relative to the receptacle. The tubular member may be formed of two telescopingly extendible members lockable in a selected extended position.

7 Claims, 5 Drawing Sheets

BODY MOUNTED FIREARM SUPPORT

CROSS-REFERENCE TO CO-PENDING APPLICATION

This application claims the benefit of pending provisional application Ser. No. 60/026,061, filed Sep. 13, 1996.

BACKGROUND OF THE INVENTION

1. Field of the Invention

The present invention relates, in general, to firearms and, more particularly, to firearm supports.

2. Description of the Art

While hunting, hunters frequently carry a firearm over long distances and for a considerable period of time before a target presents itself. When a target comes within range, the hunter must be able to quickly and quietly move the firearm into a firing position without alerting the animal or requiring an extended period of time which would enable the animal to move out of firing range.

Various holders or supports have been devised for supporting a firearm during non-firing activities, such as walking, etc. Other holders or supports have been devised to provide the separate function of supporting a firearm in a firing position for extended periods of time to eliminate fatigue which is known to interfere with proper sighting of the firearm.

Such firearm supports or holders have been, in some instances, attached to a belt worn by the hunter. However, such firearm supports have not provided all of the desired characteristics of a support, namely, enabling the firearm to be easily supported without fatigue in a non-firing position, enabling a firearm to be quickly and quietly moved into a firing position, and enabling the firearm to be easily moved in the support in any position to enable the hunter to track a target.

Thus, it would be desirable to provide a firearm support which enables a firearm, particularly a rifle or shotgun, to be easily carried by a hunter without causing excessive fatigue. It would also be desirable to provide a firearm support which enables a firearm to be easily moved from a storage position into a firing position in a quick, quiet manner. It would also be desirable to provide a firearm support which can be easily attached to various firearms, both with and without sight mounts. It would also be desirable to provide a firearm support which supports a firearm adjacent to the body of a hunter to enable easy, unhindered movement of the hunter through brush and under trees. It would also be desirable to prevent a firearm support which is easily attachable to many variety of firearms without modification to such firearms. Finally, it would be desirable to provide a firearm support which enables a firearm supported on the support to be easily moved, while in a firing position, into substantially any position to enable a hunter to track a target.

SUMMARY OF THE INVENTION

The present invention is a body mounted firearm mount which provides an easy and convenient means for a hunter to carry a firearm. The support is also capable of providing a stable, stationary platform when the firearm is moved into a firing position.

In a preferred embodiment, the support comprises:

an elongated tubular member having first and second ends;

means, attachable to a belt worn by a user, for supporting the first end of the tubular member; and means, carried on the second end of the tubular member, for movably attaching the second end of the tubular member to a firearm.

Preferably, the means for attaching the second end of the tubular member to the firearm provides a pivotal attachment enabling the firearm to be moved relative to the second end of the tubular member when attached thereto.

The elongated tubular member is preferably formed with an extensible, adjustable length. By way of example, the tubular member includes first and second telescopingly coupled members. Lock means, carried on the first and second members, releasably lock the first and second members in any user selected extended length to selectively vary the overall length between the opposed ends of the first and second members.

The means for supporting the first end of the tubular member on a belt worn by a user preferably includes a belt releasably mountable about the body of a user and a receptacle carried on the belt for receiving and supporting the first end of the tubular member.

In an alternate embodiment, particularly useful with firearms having a sight mount, an attachment is releasably mountable about the firearm and has an integral mount extending therefrom. The mount is attachable to a connector mounted on the second end of the tubular member.

BRIEF DESCRIPTION OF THE DRAWINGS

The various features, advantages and other uses of the present invention will become more apparent by referring to the following detailed description and drawing in which.

DESCRIPTION OF THE PREFERRED EMBODIMENT

Figure 1:
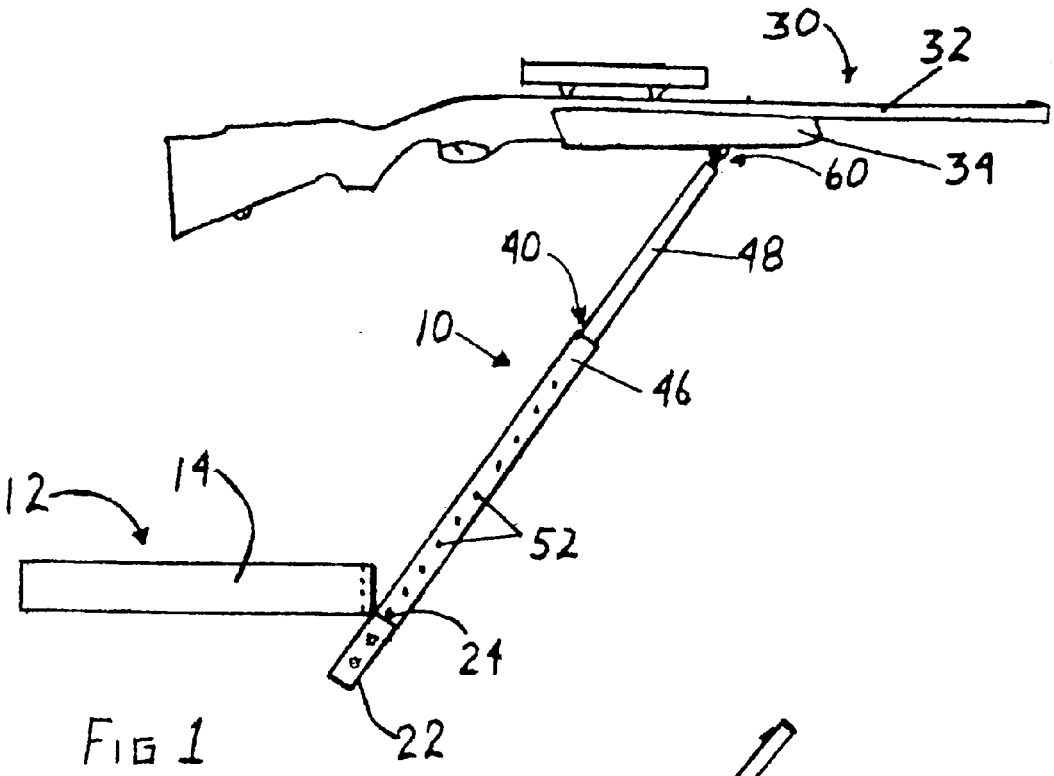
FIG. 1 is a side elevational view of the body mounted firearm support constructed in accordance with the teachings of the present invention and shown in a firing position.

The present invention, as shown in FIGS. 1–7, is a body mounted support 10 for conveniently supporting a firearm on the body of a user to assisting in supporting the weight of the firearm to enable the user to carry the firearm for a longer period of time without becoming tired.

As shown in FIGS. 1–4, the support 10 of the present invention includes body mount means 12 which are releasably attachable to the body of a user, preferably about the waist or hips of the user. The body mount means 12 includes a belt 14 having a generally planar form and formed of a flexible material, such as nylon, by example only. The belt 14 includes a releasible latch means 16 including a conventional buckle 18 and interconnectable tongue 20 which may be formed in any conventional arrangement. The latch means 16 enables the belt 14 to be releasably mounted about the waist of a user and serves to retain the belt 14 on the body of the user.

A receptacle 22 is attached to the belt 14 at a convenient location so as to enable the receptacle 22 to be disposed substantially centrally in the front of the user's body. The receptacle 22 is formed of any suitable material, such as the same material forming the belt 14. The receptacle 22 has a generally tubular configuration with an open top end 24 communicating with a hollow interior. One end of the receptacle 22 is attached to the belt 14 by means of stitching in a preferred example, but other means, such as a releasible attachment, Velcro, snaps, etc., can also be employed.

Figure 2:
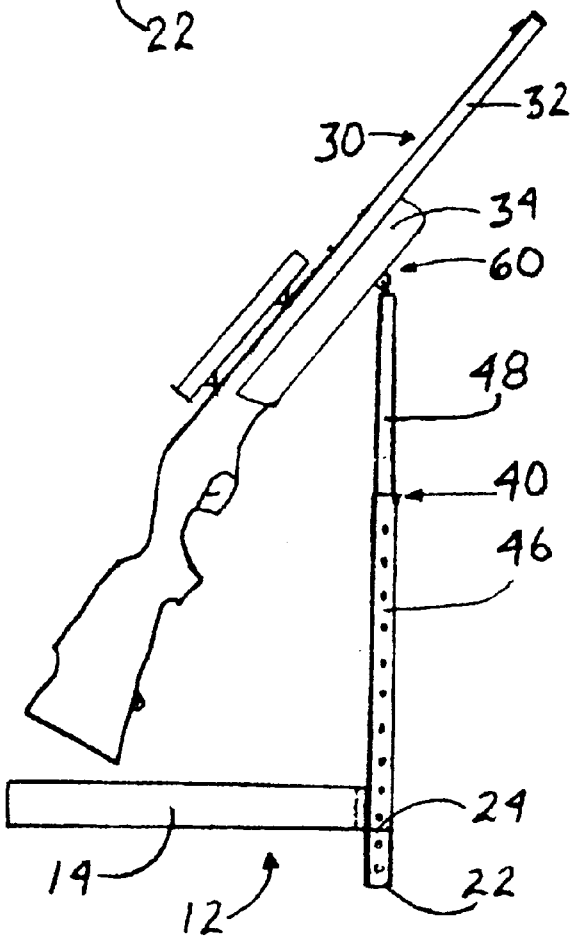
FIG. 2 is a side elevational view of the firearm support shown in a storage position.

Before describing the remainder of the body mounted firearm support 10, a brief description of a conventional firearm denoted generally by reference number 30 in FIGS. 1 and 2 will be provided to clarify the use and advantages of the body mounted firearm support 10. Reference number 30 depicts a firearm, such as a rifle. It will be understood that the use of the term "firearm" is meant to include any type of firearm including rifles, shotguns, etc., which are carried by user. Such firearms 30 typically include an elongated barrel 32 which seats within a lower rest 34. Certain firearms 30 include a sight mount 36 which is carried on or integrally formed with the lower rest 34. The sight mount 36 projects downwardly below the rest 34 and includes a through bore 38 which extends generally transverse to the longitudinal axis of the rest 34 and the barrel 32. The sight mount 36 is conventionally used to attach a mount to the front end of the firearm for supporting the front end of the firearm 30 on the ground during sighting and alignment or even during shooting of the firearm 30.

Figure 3:
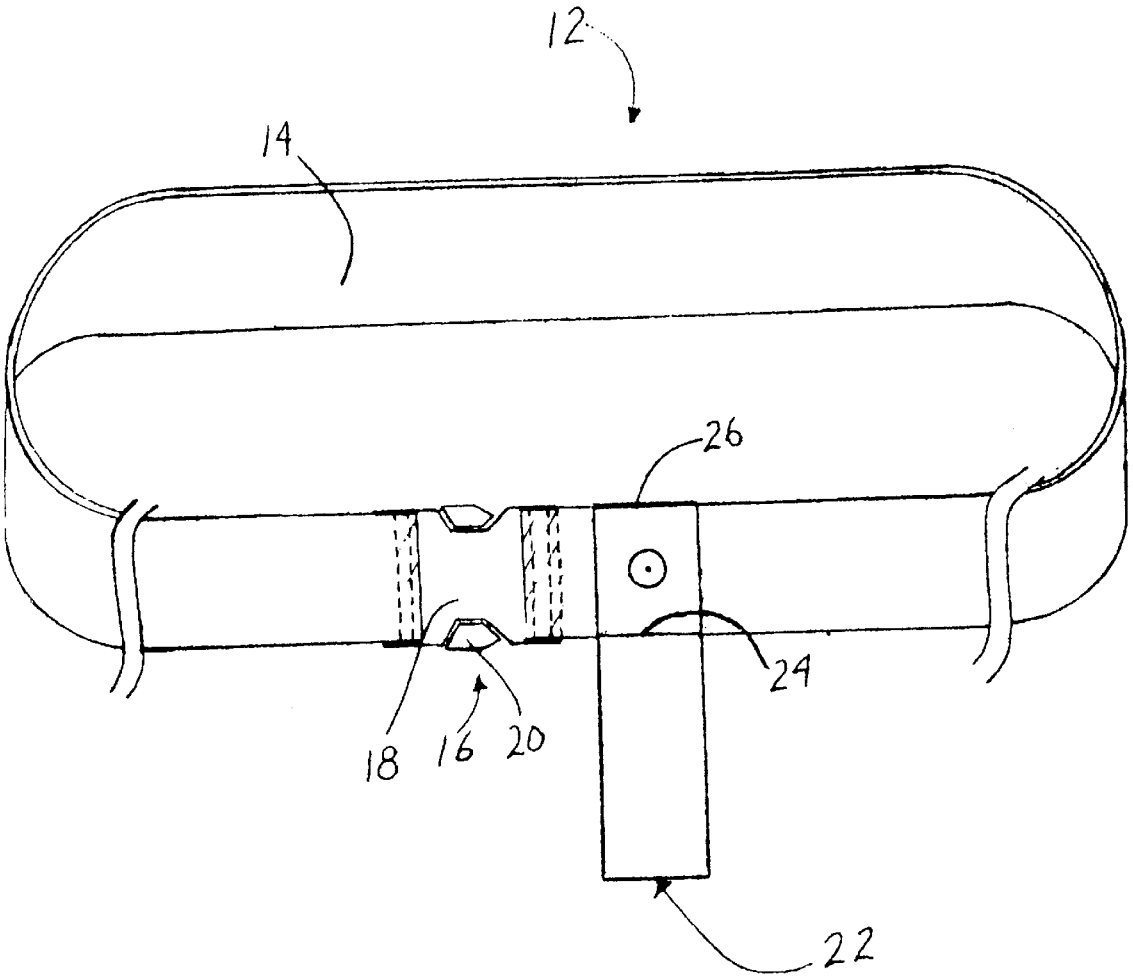
FIG. 3 is a front view of the belt and firearm mount.
Figure 4:
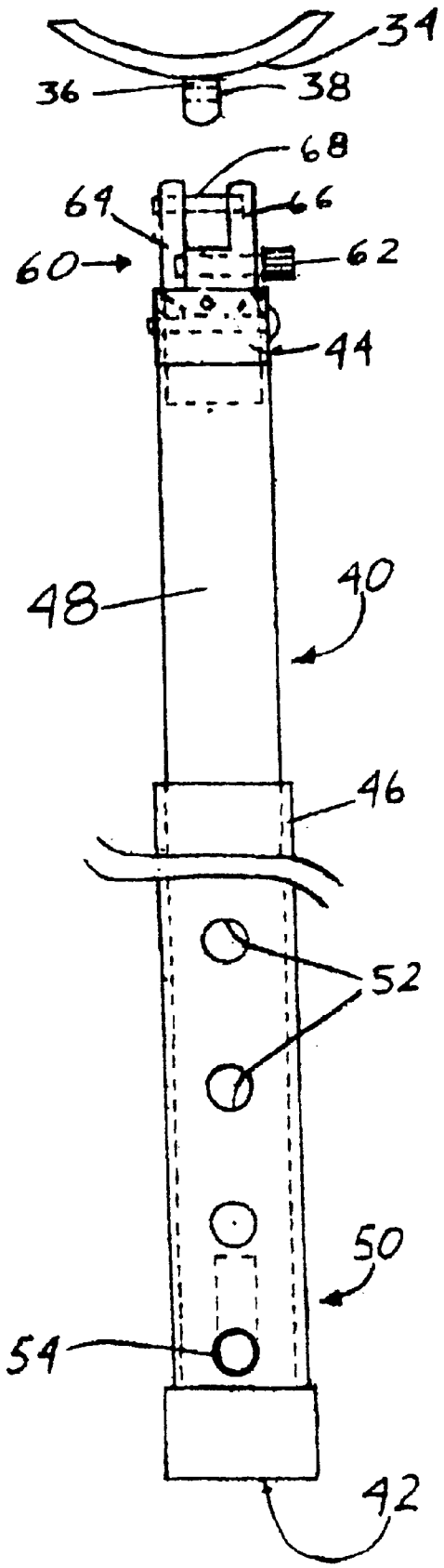
FIG. 4 is an elevational view of the rod and firearm connector of the body mounted firearm support shown in FIGS. 1–3.

The body mounted firearm support 10 includes an elongated rod 40 having a first end 42 and an opposed second end 44. Although the rod 40 could be formed of a single, elongated, one-piece member, in a preferred embodiment, as shown in FIGS. 1–3, the rod 40 is formed of two telescopingly arranged tubular members including a first member 46 and a second member 48. The second member 48 has a smaller diameter so as to telescopingly, slidingly mount within the first member 46.

Variable length adjusting means denoted by reference number 50 are provided on the first and second members 46 and 48 for telescopingly adjusting the overall length of the rod means 40 formed of the first and second members 46 and 48. In a simple embodiment, which is described by example only as illustrative of the various telescoping adjustment means usable with the present invention, a plurality of linearly spaced apertures 52 are formed in the first member 46. A spring biased latch button 54 is carried on a lower end of the second member 48 and is releasably extendible through a selected one of the apertures 52 to enable the overall length of the joined first and second members 46 and 48 to be selected according to the size of the torso of the user and the user's preference with respect to carrying the firearm 30. Depression of the latch button 54 completely through one of the apertures 52 enables the second member 48 to be adjustably slid relative to the first member 46 to a different position before the latch button 54 is released and slides outward through a different aperture 52. This locks the first and second members 46 and 48 together in any user selected overall length.

The first end 42 of the rod means or first member 46 is sized to be releasably inserted through the open top end 24 of the receptacle 22 to support the first end 42 of the rod means 40 in the receptacle 22.

The second end 44 of the rod means 40 is provided with a releasible connector 60 for attaching the second end 44 of the rod 40 to the sight mount 36. In a preferred embodiment, described hereafter and shown in FIG. 1 as an example only, a conventional sling mount 60 is securely attached to the second end 44 of the second tubular member 48. The sling mount 60 includes a spring biased shaft having a threaded end cap 62. Unthreading of the cap 62 enables the entire shaft to be urged through a first stop member 64 thereby releasing a second stop member 66 with engagement with a pin 68 extending from the first stop member 64. The shaft and the second stop member 66 may then be rotated to enable the pin 68 to be slidingly urged through the bore 38 in the sight mount 36. A reverse operation captures the end of the pin 68 in an aperture in the second stop member 66 to pivotally attach the connector 60 and the entire rod means 40 to the sight mount 36.

As shown in FIG. 2, the body mounted firearm support 10 enables a firearm 30 to be easily carried in an upright position when the hunter is moving about. In this position, substantially all of the weight of the firearm 30 is supported by the body mount 12 thereby conserving the user's arm strength for use in steadily holding the firearm during firing. At the same time, the firearm 30 and the rod means 40 of the support 10 may be easily and quickly pivoted from the non-use position shown in FIG. 2 to a firing position shown in FIG. 1 in which the firearm 30 can be discharged. Further, since the sight mount 36 on the firearm 30 is pivotally connected to the rod means 40 of the support 10, and the lower end of the rod 40 is rotatable within the receptacle 22 on the belt 14, the entire firearm 30 can be laterally displaced as well as elevated and lowered as needed for proper aim. The support 10 also provides a steady platform to support the firearm during firing.

Figure 5:
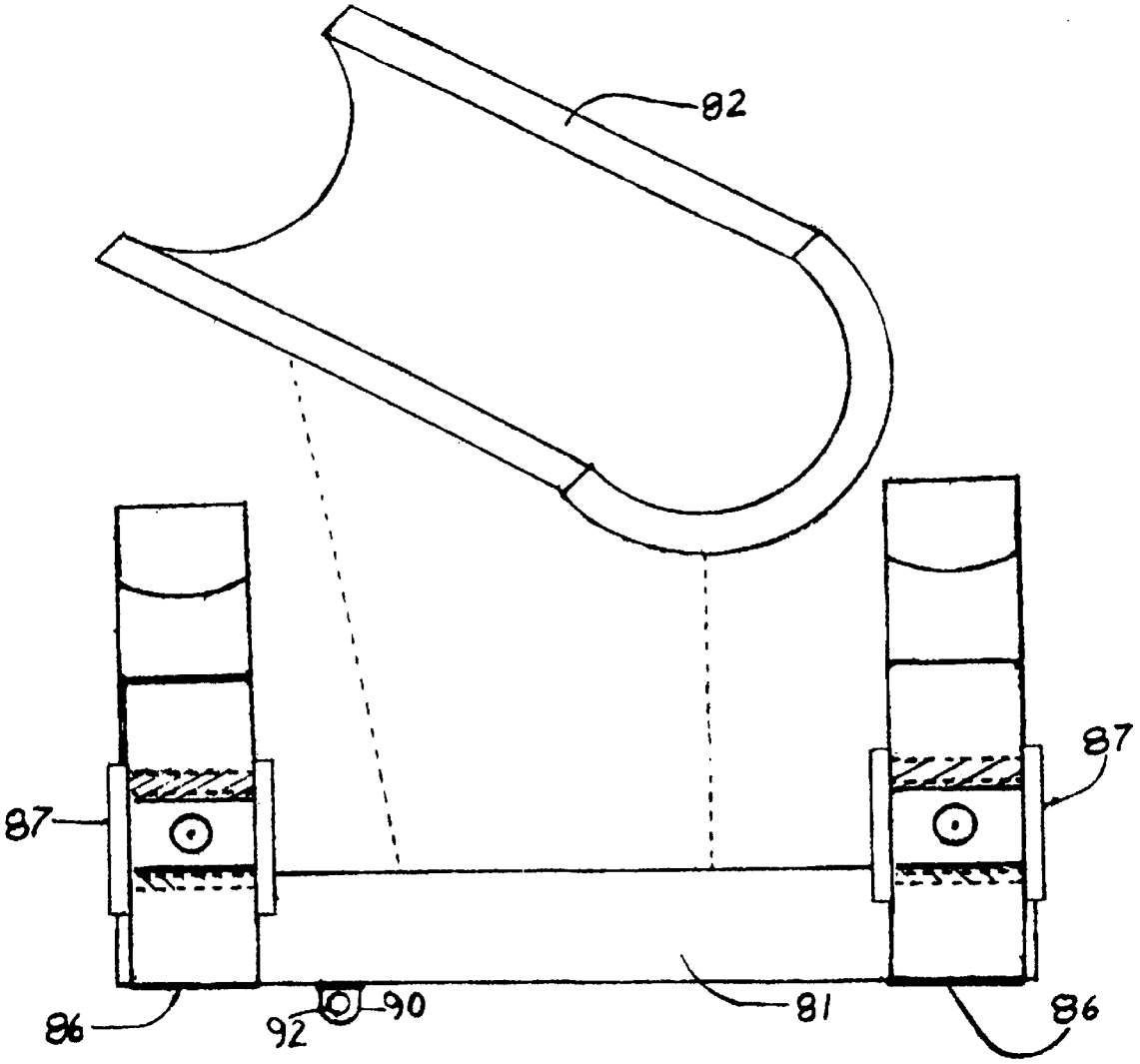
FIG. 5 is an exploded view of an alternate firearm attachment.
Figure 6:
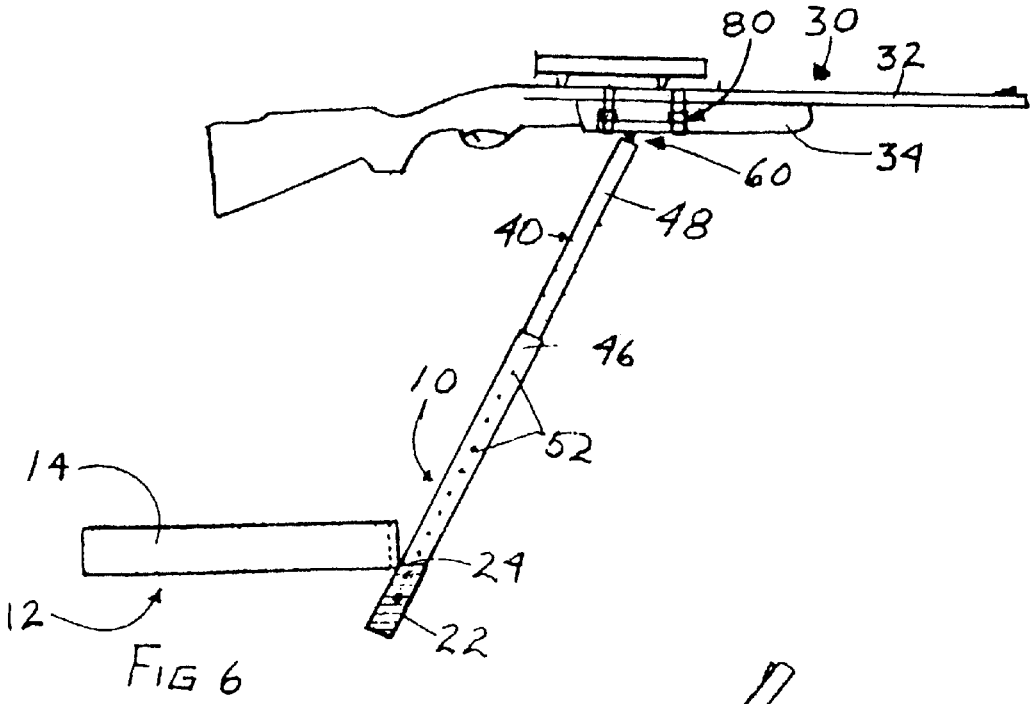
FIGS. 6 and 7 are side elevational means of the attachment of FIG. 5 in firing and storage positions.
Figure 7:
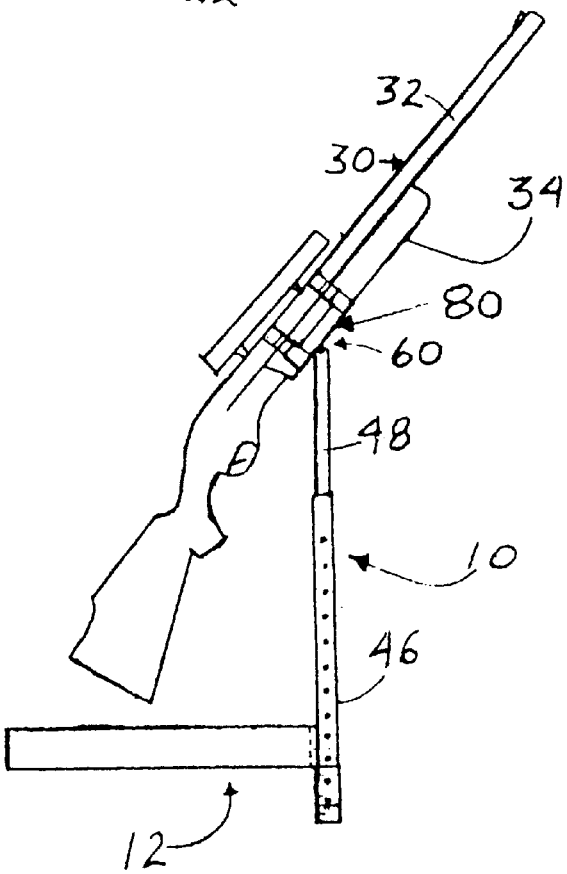

FIGS. 5–7 depict an attachment 80 for use with a firearm which does not include an integral sight mount, such as the sight mount 36 shown in FIG. 1 on the firearm 30. The attachment 80 includes an arcuate support 81 having a generally U-shape with a central, open-ended recess or cavity. The support 81 may be made of any rigid material, such as polyvinylchloride. A pad 82 is mounted in the cavity in the support 81. Preferably, the pad 82 is formed of a resilient foam material which can conform to the shape of the lower rest 34 of the firearm 30. Attachment means in the form of one or more interconnected straps 86 are mounted on the support 81. Fasteners 87, such as interconnectable buckles or VELCRO, may be employed on the ends of the straps 86 to releasably mount the attachment 40 about the lower rest and barrel of a firearm.

The attachment 80 includes a mount 90 carried on a bottom of the support 84 and extending outward therefrom. The mount 90 includes a transverse bore 92 sized to releasably receive the pin 68 on the connector 60 of the support 10. In this manner, the attachment 80 may be releasably attached to a firearm which lacks a sight mount 36. The rod means 40 of the support 10 of the present invention is then be pivotally attached to the mount 90 on the attachment 80 thereby enabling the body mounted firearm support 10 to be used with firearms lacking an integral sight mount.

Body mounted firearm support of the present invention provides many unique advantages not previously provided by firearm supports. The present firearm support enables a firearm, such as a rifle, to be easily carried by a hunter without excessive weight on the hunter's arms thereby preventing fatigue and tiredness. The firearm support enables a firearm to be carried on the body of the hunter in a suitable position which enables the hunter to easily move through brush and under trees without interference with the firearm. The present firearm support also is adjustable to the torso length of the hunter and enables the firearm to be easily, quickly and quietly moved into a firing position. The present firearm support is useable with many different varieties of firearms and does not require any modification to such firearms.

What is claimed:

1. A firearm support comprising:

an elongated tubular member having first and second ends;

a support attachable to a belt worn by a user and universally movably supporting the first end of the tubular member for rotatable movement of the tubular member about a longitudinal axis extending between the first and second ends, and pivotal and rotational movement of the tubular member relative to a user;

an attachment carried on the second end of the tubular member adapted to movably attach the second end of the tubular member to a firearm; and wherein the support enables pivotal movement of the tubular member and the attachment between a firearm firing position and a firearm safe position in which a barrel of a firearm coupled to the attachment extends upward relative to the support.

2. The firearm support of claim 1 wherein the support comprises:

a receptacle attachable to a belt and universally rotatably receiving the first end of the tubular member.

3. The firearm support of claim 1 wherein:

the tubular member includes first and second telescopingly engageable members; and further comprising lock means, carried on the first and second portions, for locking the first and second portions in a selected extended position.

4. The firearm support of claim 1 wherein the attachment comprises:

means for pivotally attaching the second end of the tubular member to the firearm.

5. The firearm support of claim 1 wherein the attachment comprises:

a receiver member releasably mountable about a firearm; and means, carried on the receiver member, for moveable connection to the attachment on the second end of the tubular member.

6. The firearm support of claim 5 wherein the attachment further comprises:

the receiver having an open channel for receiving a portion of a firearm therein;

fastener means, carried on the support, for encircling and removably fixing the firearm in the channel; and means, carried on the support, for pivotally attaching the support to the tubular member.

7. The firearm support of claim 1 wherein the attachment comprises:

a fork carried on the second end of the tubular member for receiving a sight mount of a firearm therein; and apertures formed in the fork for alignment with a bore in a sight mount for receiving a pivot pin to pivotally couple the fork to the sight mount.

* * * * *